United States Patent [19]

Rüttershoff

[11] 4,405,281

[45] Sep. 20, 1983

[54] HYDRAULIC EXCAVATOR WITH BOOM FOR LARGE RANGES OF ACTION AND LIFTING HEIGHTS

[75] Inventor: Heinz-Joachim Rüttershoff, Schwelm, Fed. Rep. of Germany

[73] Assignee: O & K Orenstein & Koppel Aktiengesellschaft, Berlin, Fed. Rep. of Germany

[21] Appl. No.: 148,424

[22] Filed: May 9, 1980

[30] Foreign Application Priority Data

May 19, 1979 [DE] Fed. Rep. of Germany ..... 2920422

[51] Int. Cl.[3] ..... E02F 3/38

[52] U.S. Cl. ..... 414/722; 414/694

[58] Field of Search ..... 414/694, 718, 722; 137/117.5; 212/176–185, 188

[56] References Cited

U.S. PATENT DOCUMENTS

| | | | |
|---|---|---|---|
| 3,465,904 | 9/1969 | Pensa | 414/718 X |
| 3,923,172 | 12/1975 | Jankowiak | 414/718 |
| 3,977,148 | 8/1976 | Ranini | 414/718 X |
| 4,029,225 | 6/1977 | Wirt | 414/694 |

*Primary Examiner*—Trygve M. Blix
*Assistant Examiner*—Terrance L. Siemens
*Attorney, Agent, or Firm*—Martin A. Farber

[57] ABSTRACT

A hydraulic excavator, with a boom lower part, a boom upper part and a stick, for conversion to operation using a gripper with large ranges of action and lifting heights. A connecting piece which rigidly connects the boom upper part and the boom lower part is fastened to the boom upper part, and is formed with an eye. A hydraulic cylinder which serves to actuate the stick is swingably mounted on the eye by means of a bolt.

4 Claims, 3 Drawing Figures

HYDRAULIC EXCAVATOR WITH BOOM FOR LARGE RANGES OF ACTION AND LIFTING HEIGHTS

The present invention relates to a hydraulic excavator, with a boom lower part, a boom upper part and a stick, for conversion to operation using a gripper with large ranges of action and lifting heights.

In one known arrangement on excavators for increasing the range of action and the lifting height of the equipment, a two-point support is used for raising the upper part of the boom. In this case, the point of articulation of the stick cylinder is not moved away from the boom upper-part so that it is not possible to use the full force of the cylinder since the actuation is effected on the rod side.

In another known arrangement, a connecting rod is used as a two-point support for the suspension of the boom upper part, which is turned over 180° compared to the normal orientation. In this way, while an optimum utilization of the cylinder force is provided, a large expenditure is required for the conversion, i.e. conversion without auxiliary means in the form of a hoisting device is not possible.

Furthermore the turning over of the upper part of the boom makes considerable changes necessary in the hydraulic piping. Due to the fixed point of the cylinder on the upper part of the boom, a free form of the range of motion of the stick is not possible, this resulting in an unfavorable shape of the gripper stick.

The object of the present invention is to make it possible to convert an earth excavator from normal operation with deep shovel to gripper operation with a large radius of action and lifting heights by the use of a simple connecting piece.

This objective is achieved in accordance with the invention in the manner that a connecting piece (e.g., 23) which is fastened to the upper part (16) of the boom (12) and serves for the rigid connection of the upper part (16) of the boom to the lower part (13) of the boom is provided with an eye or lug (27) on which the hydraulic cylinder (28) serving for the actuating of the stick (19) is swingably mounted by means of a bolt (e.g., 29).

In the development of the invention, the boom lower part and the boom upper part are connected to each other by the connecting piece in the manner that the connecting piece by means of two bearing eye lugs and by means of two bolts is rigidly connected to the boom upper part and by means of one bolt is rigidly connected to the boom lower part, the swinging of the stick around the boom being effected by means of a hydraulic cylinder which is swingably mounted by means of a bolt in a bearing eye lug arranged on the connecting piece.

One embodiment of the arrangement of the invention is shown by way of example in the drawings, in which.

Figure 1:
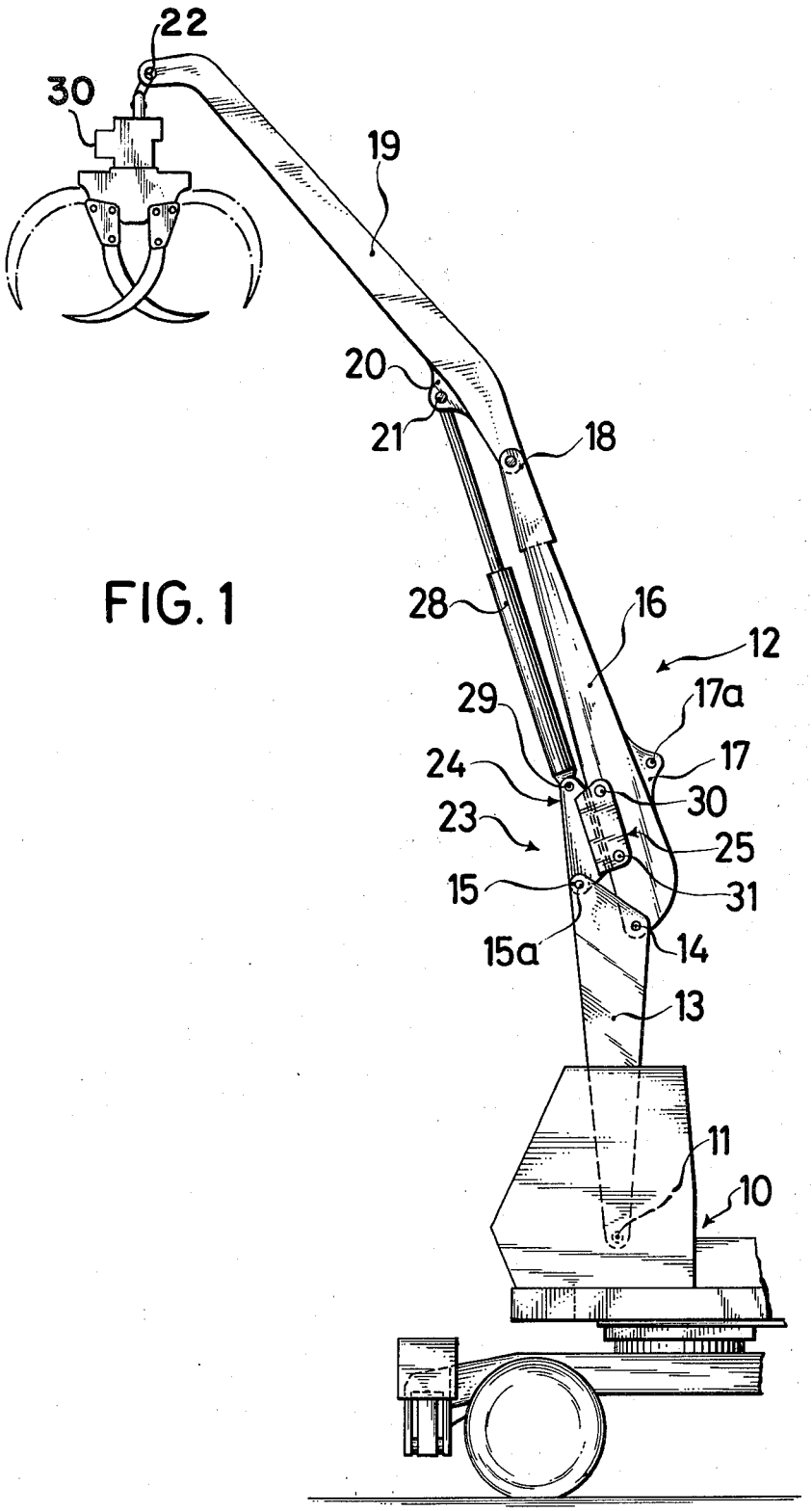
FIG. 1 is a side view of a mobile excavator.
Figure 2:
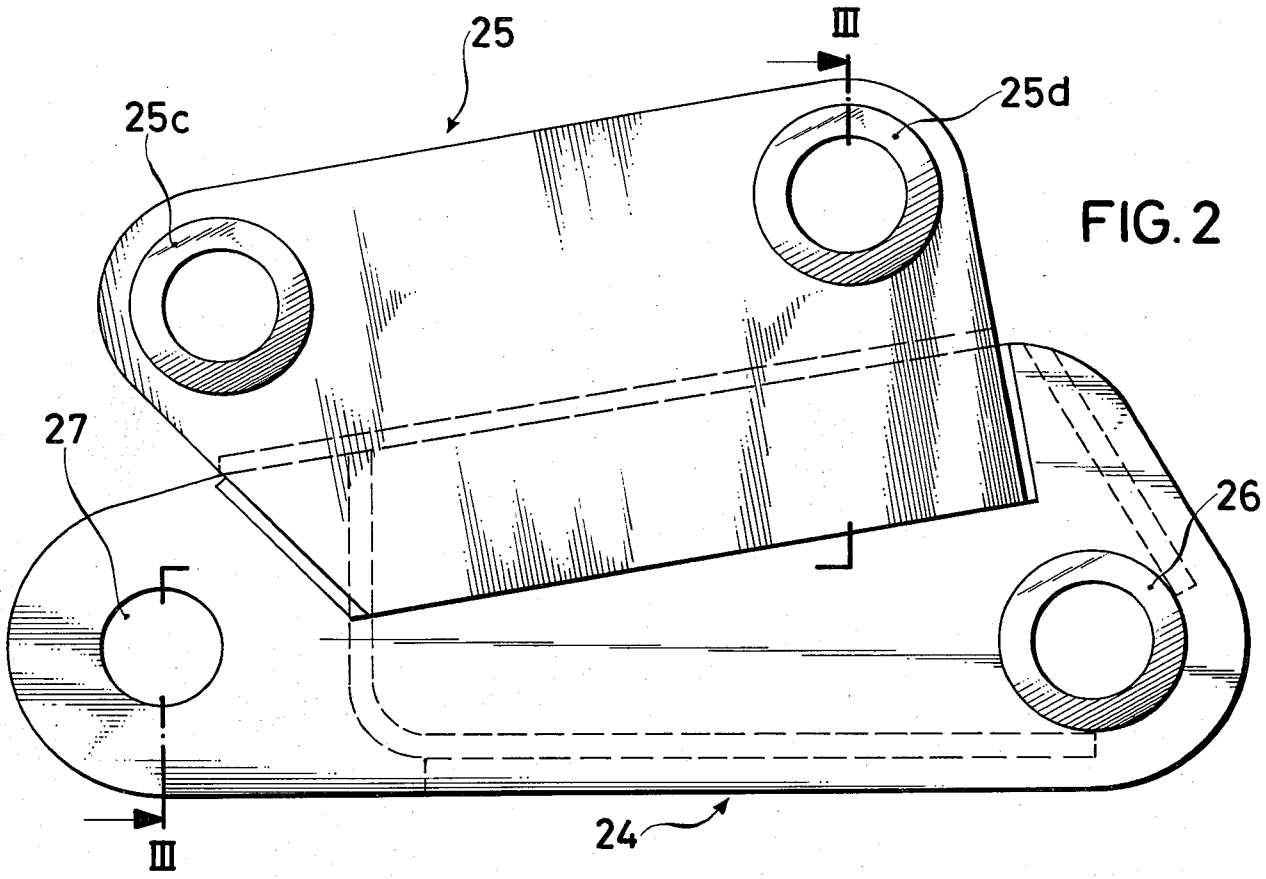
FIG. 2 is a side view of the connecting piece to be inserted between the boom lower part and the boom upper part, shown on a larger scale.
Figure 3:
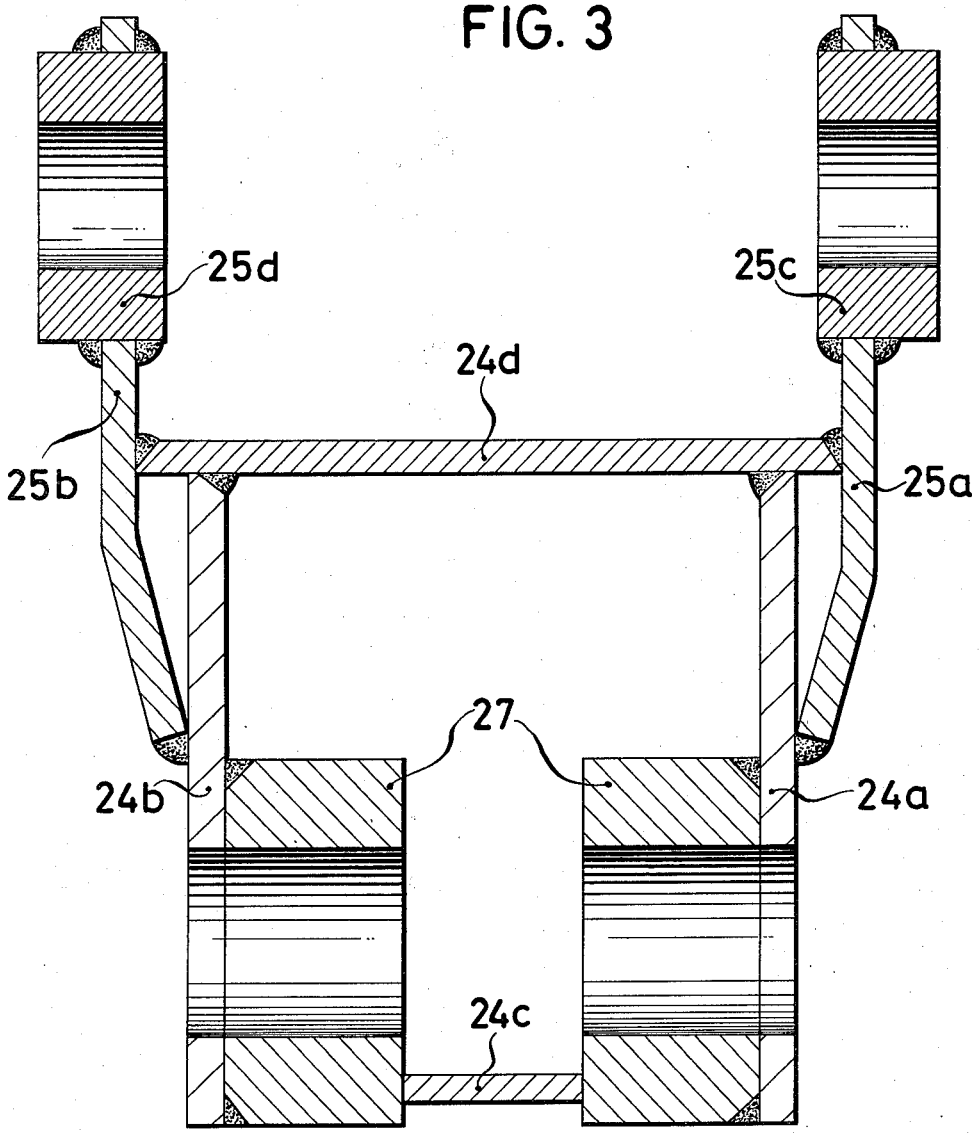
FIG. 3 is a cross section through the connecting piece along the sectional cut shown in FIG. 2.

On an upper chassis or frame 10 of a mobile excavator a boom 12 is swingably articulated at a pivot point 11; this boom comprises of the boom lower part 13 with the pivot point 11 on the upper frame 10. On the free end of the boom lower part 13 there are arranged the bearing points 14 and 15. The boom upper part 16 is articulated in the bearing point 14, the upper part 16 being formed on its top with a lug 17 with the pivot point 17*a*. On the free end of the boom upper part 16 there is arranged the pivot point 18 in which the stick 19 is rotatably articulated. The stick 19 on its lower side carries a bearing lug 20 in which the pivot point 21 is arranged therefor; at its free end the stick 19 is provided with a bearing point 22 in which the equipment can be articulated. If the mobile excavator is now to be converted to a hydraulic crane or for the actuating of gripper 30 of long reach for greater heights, it is merely necessary to connect the boom lower part 13 and the boom upper part 16 rigidly to each other by means of a connecting piece 23 which comprises the two main parts 24 and 25 which are welded to each other (FIGS. 2 and 3) and to connect the hydraulic cylinder 28 as shown. The main part 24 comprises a box formed of two stays 24*a* and 24*b* and two cover plates 24*c* and 24*d* welded together. To the main part 24 there are welded two plates 25*a* and 25*b* which form the main part 25 and in which plates the two bearing lugs 25*c* and 25*d* serving for attachment to the boom upper part 16 are respectively arranged. The lug 26 serves for connection with the bearing point 15 of the boom lower part 13; the hydraulic cylinder 28 serving for the actuation of the stick 19 is articulated to the bearing lug 27.

I claim:

1. In a hydraulic excavator having a chassis a boom comprising a boom lower part pivotally mounted to said chassis, and a boom upper part normally pivotally connected to the boom lower part, and having a stick pivotally connected to the boom upper part, the improvement for conversion of the excavator to operation using a gripper with large ranges of action and lifting heights, comprising a connecting piece constituting means for rigidly connecting said boom upper part and said boom lower part, said connecting piece being connected to the boom upper part, said connecting piece is formed with an eye, a hydraulic cylinder means for actuating said stick, bolt means for swingably mounting said hydraulic cylinder means on said eye.

2. The hydraulic excavator according to claim 1, wherein said connecting piece is formed with two additional eyes, two additional bolt means for rigidly connecting said connecting piece with said boom upper part in said two additional eyes, respectively, another bolt means for rigidly connecting said connecting piece with said boom lower part, said hydraulic cylinder means is for swinging said stick around said boom.

3. The hydraulic excavator according to claim 2, wherein said connecting piece comprises two main parts, one of said two main parts includes said two additional eyes, the other of said two main parts includes said another bolt means and said eye.

4. The hydraulic excavator according to claim 3, wherein said other of said main parts includes two stays and two cover plates which are welded together, respectively, and form a box.

* * * * *